US005131567A

United States Patent [19]

Lipsey

[11] Patent Number: 5,131,567

[45] Date of Patent: Jul. 21, 1992

[54] COMPRESSOR FOR EXPRESSING THE CONTENTS OF TUBES

[76] Inventor: Robert E. Lipsey, 6719 Wemberly Way, McLean, Va. 22101

[21] Appl. No.: 607,469

[22] Filed: Oct. 31, 1990

[51] Int. Cl.[5] ..... B65D 35/00

[52] U.S. Cl. ..... 222/102

[58] Field of Search ..... 222/102, 92

[56] References Cited

U.S. PATENT DOCUMENTS

| | | | |
|---|---|---|---|
| 1,773,104 | 8/1930 | Johnson | 222/102 |
| 1,983,462 | 12/1934 | Johnson | 222/102 |
| 4,627,551 | 12/1986 | Kopp | 222/102 |

FOREIGN PATENT DOCUMENTS

| | | | |
|---|---|---|---|
| 466853 | 10/1928 | Fed. Rep. of Germany | 222/102 |
| 830828 | 2/1952 | Fed. Rep. of Germany | 222/102 |
| 3007015 | 9/1981 | Fed. Rep. of Germany | 222/102 |
| 820722 | 7/1936 | France | 222/102 |
| 1272937 | 3/1960 | France | 222/102 |
| 2409206 | 7/1979 | France | 222/102 |
| 136333 | 7/1979 | German Democratic Rep. | 222/102 |
| 444344 | 1/1949 | Italy | 222/102 |
| 620967 | 5/1961 | Italy | 222/102 |

*Primary Examiner*—Michael S. Huppert
*Assistant Examiner*—Anthoula Pomrening
*Attorney, Agent, or Firm*—Charles E. Lipsey

[57] ABSTRACT

A tube compressor for expressing the contents of collapsible but not permanently deformable tubes is provided having upper and lower tube compressing members which can be subjected to counter-rotational movement to move the compressing members along the length of the tube to be compressed while confirming the contents of the tube to the area between the compressing members and the opening of the tube.

4 Claims, 3 Drawing Sheets

COMPRESSOR FOR EXPRESSING THE CONTENTS OF TUBES

BACKGROUND OF THE INVENTION

1. Field of the Invention

The present invention relates generally to the field of packaging and dispensing of products, particularly consumer products, and most specifically to dispensation of products from collapsible tubes. In its broadest respects, the invention relates to mechanical devices for use on or in association with containers in the form of collapsible tubes containing viscous materials to be dispensed therefrom.

2. Background of the Invention

For many years, products in the form of viscous liquids or semi-solid pastes have been packaged for dispensation by the consumer in containers in the form of collapsible tubes. In use, the consumer would apply compressive force to the outside of the tube to extrude the needed amount of the material contained in it through a closable orifice at the end of the tube.

Initially, such tubes were made from thin metal foils, with or without non-metallic coating materials. The metallic foils from which such tubes were made were permanently deformable, with the result that the end of the tube remote from the opening could be crimped and folded as the contents of the tube were consumed, thereby progressively decreasing the operative volume of the tube. With such constructions, the remaining volume of the tube contents was always presented as a mass occupying all or nearly all of the diameter of the tube and was prevented from being extruded by the application of compressive forces back into the previously collapsed area of the tube. Accordingly, the remaining contents of the tube could be expelled by the application of relatively minor compressive force on the remaining filled volume of the tube.

With the advent of more modern packing materials, a variety of industrial and consumer products previously dispensed in permanently deformable metal tubes have come to be dispensed in tubular packages made from plastics and other non-metallic materials. While these newer packaging materials provide many advantages in terms of economy of manufacture, protection of the contents, and outward physical appearance, many of the materials used for this purpose are no longer permanently deformable in the way that the previously used metal tubes were. Utilization of such non-permanently deformable tubular packaging materials results in tubular packages which are not capable of confining the remaining contents of the tube to the area of the tube nearest the opening. Accordingly, much time and consumer aggravation is incurred in laboriously compressing the tube from the end remote from the opening through the full length of the tube until the remaining contents of the tube have been forced to the end from which they can be expelled. Attempts to crimp or roll the ends of such tubes in the manner heretofore used with permanently deformable metal tubes may result in temporary deformation of the tube but has not generally been successful in permanently reducing the operative volume of the tube.

In an effort to deal with the inconvenience and aggravation associated with this phenomenon, a variety of mechanical devices have been developed for use in association with such non-permanently deformable tubes to confine the remaining contents of the tube to the end of the tube nearest the opening. For example, it has been proposed to use a slotted key-like device to engage the bottom of the tube and to roll a portion of the bottom of the tube about the key member to express the contents therefrom and to prevent the remaining contents from reentering the collapsed portion of the tube. These devices have been unsatisfactory in preventing tubular packages made from modern non-permanently deformable packaging material from unrolling upon the application of compressive force to the remaining volume of the tube.

It has also been proposed to employ clip-type devices clamped to the bottom of the tube to hold a manually folded portion of the end of the tube in place during normal use of the tube. Such devices suffered from significant inconvenience associated with repeated opening and closing of the clipped device as the contents of the tube is expended. Moreover, these devices suffered from a general inability of the force exerted by the clip to prevent extrusion of the remaining contents of the tube back into the previously folded area of the tube, apparently due to an inability of such devices to exert a uniform compressive force across the entire cross-section of the tube.

Accordingly, there remains a need for a simple, inexpensive device to be used on or in association with tubular packages made from non-permanently deformable packaging materials which will permit the certain and facile confinement of the remaining contents of such tubes to the end of the tube closest to the outlet.

SUMMARY OF THE INVENTION

The present invention overcomes the problems and disadvantages of the prior art by providing a compressor device for expressing the contents of collapsible but not permanently deformable tubular packages. In its simplest respects, the device includes upper and lower tube compressing members which are aligned parallel to each other in a plane and which each have an outside end and an inside end. The inside end of the upper tube compressing member is overlapped by the outside end of the lower tube compressing member to form an area in which uniform compressive forces can be applied across the entire cross-section of a tube placed between them.

The device includes a pair of connecting members spaced along the overlapping portion of the first and second tube compressing members. The connecting members serve to hold the tube compressing members in a predetermined relationship to each other as well as a number of other functions. The surface of each of the tube compressing members along at least a portion of their axial length between the connecting members comprises a material which has a predetermined coefficient of friction.

The device includes rotational energy transmitting means for causing one of the tube compressing members to rotate in a direction opposite to a rotation imparted to the end of the other tube compressing member.

The connecting members hold the tube compressing members in fixed relation to each other both laterally and longitudinally during normal operation of the device through exertion of a compressive force. They also provide means for permitting counter-rotational movement of the tube compressing members upon application of a rotational force to the outside end of one or both of the members. The connecting members also provide means for adjusting the distance between them along the area of overlap of the tube compressing members to accommodate the insertion of tubes of varying widths between the tube compressing members. Finally, the connecting members provide means for altering the lateral distance between the tube compressing members to accommodate insertion between them of the end of the tube to be compressed.

The flexural modulus of tube compressing members, the coeffecient of friction of the material on the surface of the tube compressing members, and the compressive force exerted by the connecting members are balanced to allow concurrent performance of a variety of functions. First, they permit separation of the tube compressing members sufficient to allow insertion of the tube to be compressed between them. These parameters are adjusted to permit the device to do so while concurrently exerting sufficient compressive force upon the tube to (1) completely collapse the tube along a line defined by the area of overlap between the tube compressing members and (2) effect tube compressing translational movement of the tube compressing members axially along the tube in response to rotation of the outside ends of one or both tube compressing members, thereby confining the contents of the tube to a portion of the tube between the area of overlap of the tube compressing members and the mouth of the tube.

The invention may be practiced in a variety of embodiments. For example, it can be in the form of a reusable, adjustable device which can be used serially with a variety of different tubular containers. Alternatively, the invention may be embodied in a disposable device integrally associated with a tubular package at the time of distribution to the ultimate consumer.

In whatever form the invention is practiced, it provides a rapid, effective, and inexpensive means for reliably confining the remaining contents of non-permanently deformable tubular packages to the end of the tube closest to the opening, thereby eliminating inconvenience, aggravation, and waste previously associated with the use of such packages and not effectively dealt with by the prior art.

Additional objects and advantages of the invention will be set forth in part in the description which follows, and in part will be clear from the description, or may be learned by practice of the invention. These objects and advantages of the invention will be realized and obtained by means of the devices and instrumentalities particularly pointed out in the appended claims.

It is to be understood that the general description above and the following detailed description and drawings are exemplary and explanatory only and do not limit the invention as claimed.

BRIEF DESCRIPTION OF THE DRAWINGS

The accompanying drawings, which are incorporated in and constitute a part of this specification, illustrate several exemplary embodiments of the invention and, together with the description, serve to explain the principles of the invention.

DESCRIPTION OF THE PREFERRED EMBODIMENTS

Reference will now be made in detail to the currently preferred embodiments of the invention, examples of which are illustrated below and in the accompanying drawings.

As used herein, the term "non-permanently deformable" means incapable of retaining a crimped and folded configuration sufficient to confine the contents of a tubular package to the full volume of the tube closest to the end of the tube under pressure sufficient to expel the contents through the end of the tube. Obviously, materials falling within this definition may be deformable to a greater or lesser extent and may even retain some or all of this deformation for a short period of time or even permanently in the absence of compressive forces. However, the term is intended to be used in a functional sense to define tubular packaging materials of the sort where the end of the tube cannot be effectively crimped to reduce the effective volume of the tube as the contents are expended.

Figure 1:
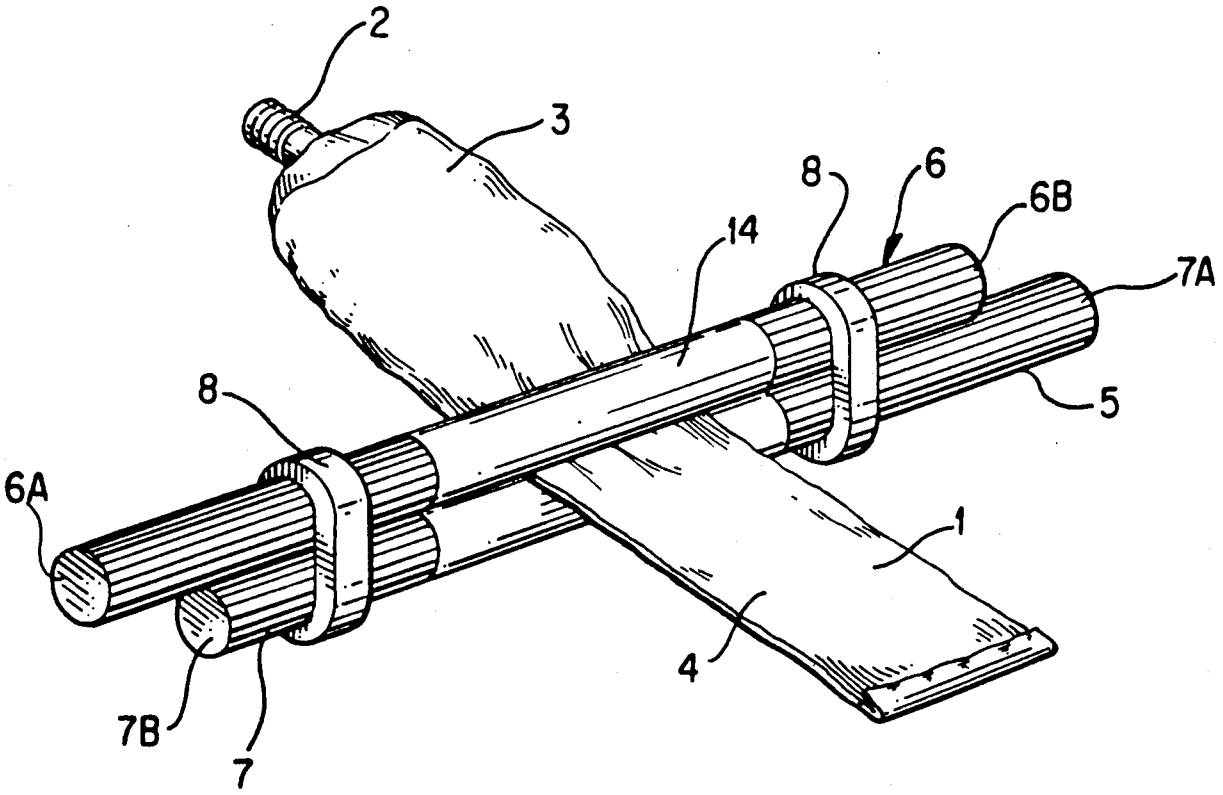
FIG. 1 illustrates an embodiment of the invention whereby the tube compressing device may be adjusted to accept tubes of varying widths and thicknesses.

Reference will now be had to specific embodiments of the invention in relation to the figures. As shown in FIG. 1, a non-permanently deformable tubular packaging material 1 is provided with an opening 2 through which the contents of the tube may be expelled. As the contents of the tube are expended, it is desired to confine the remaining contents to the full volume of the portion of the tube 3 nearest the opening 2. It is also desirable to prevent the contents of the tube from reentering the portion of the tube 4 remote from the opening 2 as compressive forces are applied to the portion of the tube 3 containing the remaining volume of the contents. Toward this end, a tube compressing device in accordance with the present invention 5 is illustrated.

In its simplest respects, the device includes an upper tube compressing member 6 and a lower tube compressing member 7. The tube compressing members 6 and 7 are aligned parallel to each other in a plane and each has an outside end 6A, 7A and an inside end 6B, 7B. The inside end of the upper tube compressing member 6B is overlapping by the outside end of the lower tube compressing member 7A.

A pair of connecting members 8 are spaced along the overlapping portion of the upper and lower tube compressing members 6 and 7. The surface of each of the tube compressing members 6 and 7 along at least a portion of their axial length between the connecting members 8 is composed of a material 14 which has a predetermined coefficient of friction.

Figure 2:
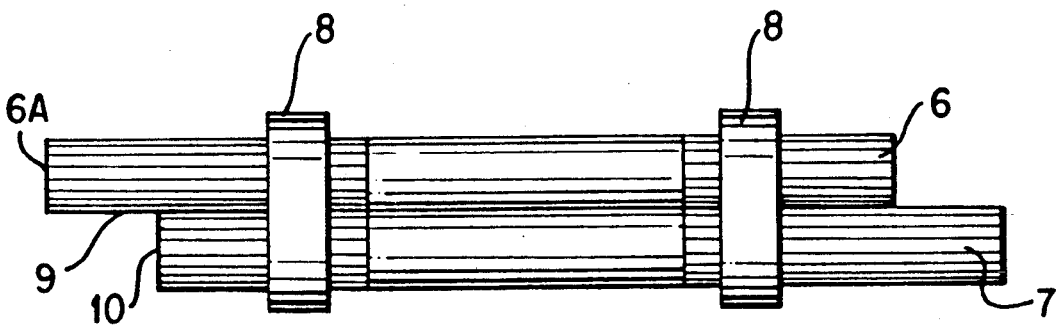
FIG. 2 is a frontal view of one embodiment of the tube compressing device.

As shown in FIG. 2, the device includes rotational energy transmitting means for causing one of the tube compressing members 6, 7 to rotate in the direction opposite to a rotation of the other tube compressing member. In a preferred embodiment of the invention, the rotational energy transmitting means are interlocking splined surfaces 9 and 10 along some or all of the length of the tube compressing members 6, 7. In operation, the splined surfaces of upper tube compressing member 6 are held during normal operation in mechanical engagement with the splines on lower tube compressing member 7 by a compressive force exerted by connecting members 8, such that application of a rotational force to the outside end of the upper tube compressing member 6A will cause a counter-clockwise rotational movement of the lower tube compressing member 7.

Figure 4:
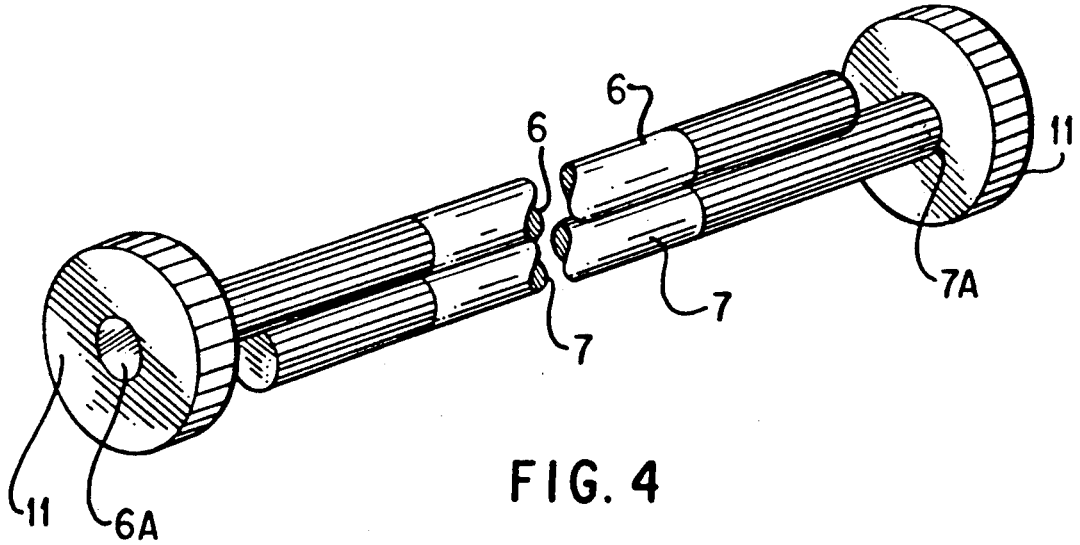
FIG. 4 is a sectional view illustrating one form of a rotational energy transmitting member affixed to the end of a tube compressing member for moving the compressor laterally along the tube to be compressed.

Suitable means for application of a rotational force to one or both tube compressing members is illustrated in FIG. 4. As shown there, a manually rotatable knob 11 is affixed to the outside end 6A of the upper tube compressing member 6. When a counterclockwise rotational motion is imparted to knob 11, a counterclockwise rotational motion will also be imparted to upper tube compressing member 6, while a concomitant clockwise rotation will be imparted to lower tube compressing member 7. The result, as shown in FIG. 1, will be movement of the entire tube compressing assembly axially along the length of the tube to be compressed 1 in a direction toward the opening of the tube 2. Such movement of the tube compressing device forces the remaining contents of the tube into the full volume of the portion of the tube remaining between the device 5 and the opening of the tube 2. Application of compressive force to the remaining full volume of the tube 3 for purposes of expelling the contents through the opening 2 does not result in extrusion of the remaining contents into the flattened portion of the tube 4 by virtue of the compressive forces exerted on the tube by the tube compressing members 6 and 7.

In a particularly preferred embodiment of the invention, a manually rotatable knob 11 is provided on the outside ends of both the upper tube compressing member 6 and the lower tube compressing member 7. In this embodiment of the invention, movement of the tube compressing device 5 axially along the length of the tube to be compressed 1 is effected by application of a counterclockwise rotational movement to the knob 11 affixed to upper tube compressing member 6 while a concurrent clockwise rotational movement is applied to the knob affixed to lower tube compressing member 7.

Figure 3:
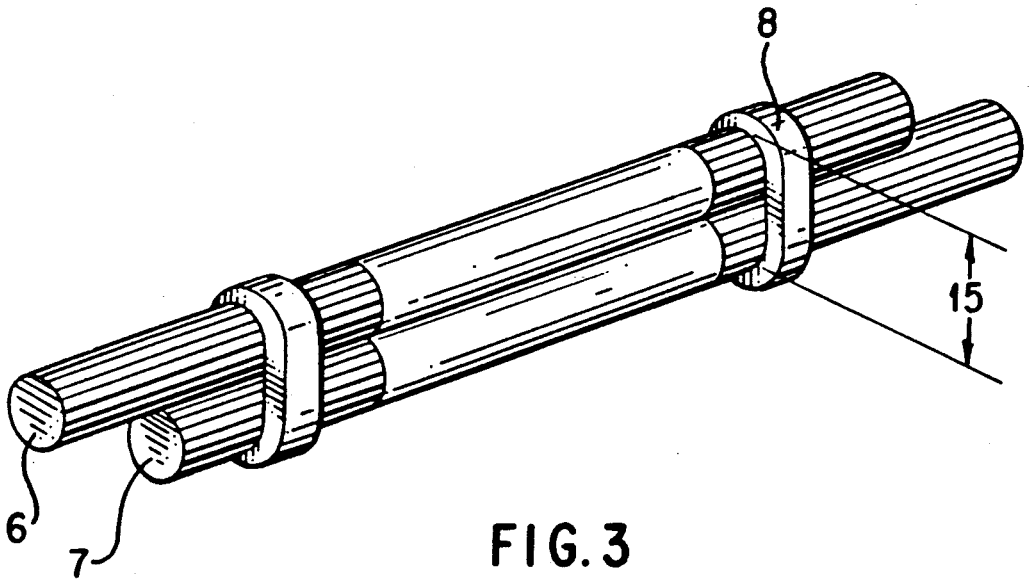
FIG. 3 is a perspective view of one embodiment of the tube compressing device.

The connecting members 8 may take a variety of forms as long as they perform the functions specified herein. In a preferred embodiment of the invention illustrated in FIG. 1, the compressing members 8 take the form of a slightly deformable plastic strap. As shown in FIG. 3, the connecting member 8 has an inside diameter 15 slightly smaller than the combined diameters of the upper and lower tube compressing members 6 and 7. The connecting member 8 is slightly deformable, but only to the extent of permitting expansion of the inside diameter 15 to a dimension equal to the combined diameters of upper and lower tube compressing members 6 and 7 plus the flattened thickness of the tube to be compressed.

The interior surface of the compressing member 8 must have a sufficiently low coefficient of friction to operate as a bearing, permitting counter-rotational movement of upper and lower tube compressing members 6 and 7 within it. In this regard, it has been found that rubbery materials of the sort commonly employed in rubber bands are unsatisfactory in several respects. In the first instance, the compressive forces exerted by such materials are generally insufficient to maintain the relationship between the upper and lower tube compressing members required to prevent extrusion of the contents of the tube to be compressed back into the flattened area of the tube during operation. Secondly, the coefficient of friction between such materials and the splined surfaces of the tube compressing members 6 and 7 is so high that counter-rotational movement of those elements was unduly impaired. Particularly preferred materials for the connecting members 8 include branched and linear polyethylenes, polytetrafluoroethylenes and other fluorinated and chlorinated hydrocarbon polymers, as well as nylon 66 and other polyamides.

In a preferred embodiment, the distance between the connecting members 8 may be adjusted by sliding the members 8 laterally toward or away from each other along the overlapping portion of upper and lower tube compressing members 6 and 7. Such adjustment permits utilization of the device with a wide variety of tubular products of varying sizes. In use, the distance between the connecting members 8 should be adjusted to be only slightly wider than the collapsed width of the tubular product with which it is to be used.

The flexural modulus of the material employed for the upper and lower tube compressing members 6 and 7 must be selected for effective transmission of the compressive forces exerted by the connecting members 8 along the entire length of the tube compressing members between the connecting members 8. In a particularly preferred embodiment, the tube compressing members are composed of polystyrene having a diameter of about 0.25 inches. This material with this diameter was found to be suitable for use with plastic toothpaste tubes and the like having a flattened tubular width of about 2-3 inches. It is to be understood, however, that the materials selected for use in the tube compressing members, the diameters of the tube compressing members, and the spacing between the connecting members may be balanced and adjusted to accommodate tubes of greater or smaller collapsed diameter than previously described. Such adjustment may be effected by those having ordinary skill in the art in light of the teachings and examples contained herein.

Again with reference to FIG. 1, the invention, in a preferred embodiment, employs upper and lower tube compressing members 6 and 7 having a surface providing a predetermined coefficient of friction on at least a portion of the area of overlap between connecting members 8. As shown in FIG. 1, the surface 14 may be formed by application of an elastomeric sleeve over upper and lower tube compressing members 6 and 7 in the area of anticipated contact with the tube to be compressed. In a preferred embodiment, the surface having a predetermined coefficient of friction 9 is composed of a heat shrinkable plastic tubing which can be collapsed to fit securely over the splined surfaces of upper and lower tube compressing members 6 and 7.

The elastomeric plastic surface of this heat shrinkable tubing serves to co-act with the compressive forces exerted by upper and lower tube compressing members 6 and 7 through the action of connecting members 8 to allow translational movement of the entire compressor device 5 laterally along the length of the tube to be compressed 1 in a direction toward the opening thereof 2 upon the application of rotational forces to the ends of one or both of the tube compressing members 6 and 7.

While the area of the upper and lower tube compressing members presenting a surface with predetermined coefficient of friction need not be continuous, it should cover at least 50% and preferably all of the anticipated flattened width of the tube to be compressed. It must be remembered, however, that, in the embodiment where rotational energy is transmitted between the tube compressing members by splined surfaces on the tube compressing members, sufficient interacting splined surface area must be provided for the purpose of rotational energy transmission.

In an alternative embodiment, the necessary degree of friction between the upper and lower tube compressing members may be provided by selection of a material for use in forming the upper and lower tube compressing members which provides an appropriate combination of surface coefficient of friction and flexural modulus to perform both the tube compressing and translational movement imparting functions in accordance with the present invention. It is necessary for purposes of the present invention that the flexural modulus of the tube compressing members, the predetermined coefficient of friction of the material contacting the tube to be compressed, and the compressive force exerted by the connecting members be balanced so as to allow:

(a) separation of the tube compressing members sufficient to allow insertion of a tube to be compressed having a width slightly smaller than the adjusted separation between the connecting members, and (b) exertion of sufficient compressive force upon the tube so inserted as to also:

(1) completely collapse the tube along a line defined by the area of overlap between the tube compressing members and (2) effect tube compressing translational movement of the tube compressing members axially along the tube in response to rotation of the outside ends of one or both tube compressing members. In this manner, the tube compressing device in accordance with the present invention effectively confines the contents of the tube to a portion of the tube between the area of overlap of the tube compressing members and the mouth of the tube.

As previously noted, the tube compressing device of the present invention may be embodied in a variety of different forms. In a particularly preferred embodiment illustrated in FIG. 1, the tube compressing element 5 is in the form of an adjustable, reusable device which can be used with tubes of varying sizes. In this embodiment, connecting members 8 are configured in a manner which allows insertion of tubes between tube compressing members 6 and 7 having a variety of thicknesses. This may be accomplished by one of several mechanisms. For example, and as previously noted, the material selected for construction of the connecting elements 8 may be chosen to provide a range of elastic movement sufficient to accommodate tubes having a predetermined range of collapsed thicknesses. Alternatively, the flexural modulus of the upper and lower tube compressing members may be selected so as to permit flexural separation of the upper and lower tube compressing members without substantial elasticity in the connecting member 8 to allow insertion of tubes with varying flattened thicknesses.

Figure 5:
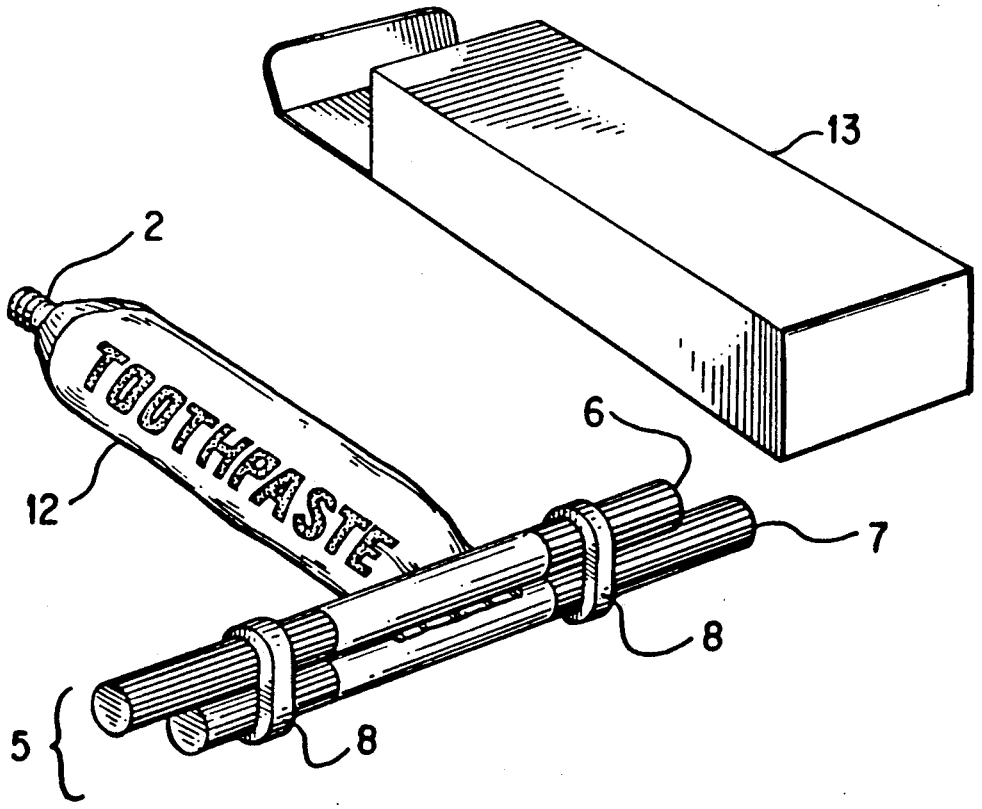
FIG. 5 is a perspective view of a second embodiment of the invention in which the tube compressing device is provided as an integral part of a packaged tubular product.

An alternative embodiment of the invention is illustrated in FIG. 5. In this embodiment, the tube compressing device in accordance with the present invention 5 is provided as an integral portion of a tubular packaged product 12. In this embodiment, the connecting elements 8 need not be adjustable laterally along the length of the upper and lower tube compressing members 6 and 7 nor need they provide sufficient elasticity to accommodate tubes of different thickness. In this embodiment, the tube compressing device 5 is used as previously described to confine the contents of the tube to the portion of the tube between the device 5 and the opening of the tube 2. This area is decreased by application of rotational forces to the ends of the upper and/or lower tube compressing members 6 and 7 as the contents of the tube are depleted to cause movement of the compressor device 5 axially along the length of the tube toward the opening 2. As also noted above, the compressive force applied along the intersection between the upper and lower tube compressing members 6 and 7 on the portion of the tube located between them is sufficient to prevent extrusion of the contents of the tube into the previously flattened portion of the tube upon application of compressive forces sufficient to expel the contents from the opening 2 of the tube 12. The entire combination of filled tube 12 and compressing device 5 may be provided to the ultimate consumer in a unitary package 13. The compressing device 5 and emptied tube 12 may then be discarded following complete utilization of the contents of the tube permitted by the attributes of the present invention.

Other embodiments of the invention will be apparent to those skilled in the art from a consideration of the specification and practice of the invention disclosed herein. It is intended that the specification and the examples be considered as exemplary only, with the true scope of the spirit of the invention being indicated by the following claims and their equivalents.

What is claimed is:

1. A tube compressor for expressing the contents of collapsible but not permanently deformable tubes comprising:

upper and lower tube compressing members, said tube compressing members being aligned parallel to each other in a plane and each having an outside end and an inside end, the inside end of said upper tube compressing member being overlapped by the outside end of said lower tube compressing member; and a pair of connecting members spaced along the area formed between the inside end of the upper tube compressing member and the inside end of the lower tube compressing member;

the surface of each of said tube compressing members along at least a portion of their axial length between said connecting members comprising a material which has a predetermined coefficient of friction;

rotational energy transmitting means for causing one of said tube compressing members to rotate in a direction opposite to a rotation imparted to the other tube compressing member;

said connecting members (a) holding said tube compressing members in fixed relation to each other both laterally and longitudinally through exertion of a compressive force during normal operation of the tube compressor, (b) permitting counter rotational movement of said tube compressing members upon application of a rotational force to the outside end of one or both of said members, (c) permitting adjustment of the distance between said connecting members to accommodate the insertion of tubes of varying widths between said tube compressing members, and (d) permitting alteration of the lateral distance between said tube compressing members to accommodate insertion of the end of the tube to be compressed between said tube compressing members, the flexural modulus of said tube compressing members, said predetermined coefficient of friction, and the compressive force exerted by said connecting members being balanced so as to allow (a) separation of said tube compressing members sufficient to allow insertion of a tube to be compressed having a width slightly smaller than the distance between said connecting members and (b) exertion of sufficient compressive force upon the tube so inserted to (1) completely collapse said tube along a line defined by said tube compressing members and (2) effect tube-compressing translational movement of said tube compressing members axially along said tube in response to rotation of the outside ends of one or both tube compressing members, thereby confining the contents of said tube to a portion of the tube between said tube compressing members and the mouth of said tube.

2. A tube compressor according to claim 1 permanently associated with a tubular packaged product the contents of which are to be expressed by said tube compressor.

3. A tube compressor according to claim 1 in which a knob for manual application of rotational forces is affixed to the outside end of both the upper and lower tube compressing members.

4. A tube compressor according to claim 1 wherein a knob for the application of rotational forces is affixed to the outside end of either the upper or lower tube compressing member.

* * * * *